US006221573B1

(12) United States Patent
Abu-Hasanayn et al.

(10) Patent No.: US 6,221,573 B1
(45) Date of Patent: Apr. 24, 2001

(54) YELLOW COUPLER, PHOTOGRAPHIC ELEMENT, AND PROCESS

(75) Inventors: Faraj Abu-Hasanayn, Rochester; Beata Owczarczyk; Thomas R. Welter, both of Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/428,339

(22) Filed: Oct. 27, 1999

(51) Int. Cl.[7] ..... G03C 7/32

(52) U.S. Cl. ..... 430/556; 430/557

(58) Field of Search ..... 430/558, 556, 430/557

(56) References Cited

U.S. PATENT DOCUMENTS

| | | | | |
|---|---|---|---|---|
| 2,264,123 | | 11/1941 | Schmitt et al. . | |
| 2,331,326 | | 10/1943 | Kendall et al. . | |
| 3,227,554 | | 1/1966 | Barr et al. . | |
| 3,993,500 | | 11/1976 | Shiba et al. . | |
| 5,081,225 | | 1/1992 | O'Sullivan et al. . | |
| 5,314,797 | | 5/1994 | Yoshioka et al. . | |
| 5,674,667 | | 10/1997 | Clark et al. . | |
| 6,015,658 | * | 1/2000 | Welter et al. | 430/557 |
| 6,057,087 | * | 5/2000 | Welter et al. | 430/557 |

FOREIGN PATENT DOCUMENTS

| | | |
|---|---|---|
| 0 751 427 | 1/1997 | (EP) . |
| 5005974 | 1/1993 | (JP) . |

OTHER PUBLICATIONS

JP 2109P98—Abstract—Silver halide colour photographic material—comprises silver halide emulsion layer(s) contg. acyl acetamido–type yellow coupler in a support.

E.K.S. Vijayakumar, K. Roy, S. Chatterjee, S.K. Deshmukh, B.N. Ganguli, H.–W. Fehlhaber, H. Kogler: "Arthrichitin. A New Cell Wall Active Metabolite from Arthrinium phaeospermum" J. Org. Chem. (Joceah, 00223263), vol. 61, No. 19, 1996, pp. 6591–6593, XP002110134—Abstract.

K. Mohri, T. Yoshioka, Y. Oikawa, O. Yonemitsu: "Application of the DDQ oxidation to the synthesis of oxidized indole alkaloids" Fukusokan Kagaku Toronkai Koen Yoshishu 12$^{th}$ (42VCA9), 1979, pp 291–295, XP002110135, Tokyo—Abstract.

Y. Noda, K. Takai, T. Tokuyama, S. Narumiya, H. Ushiro, O. Hayaishi: "Tryptophan Side Chain Oxidase from Pseudomonas" Journal of Biological Chemistry, vol. 253, No. 14, 1978, pp 4819–4822, XP002110136 American Society of Biological Chemists, Baltimore, MD, US ISSN: 0021–9258.

S. Ito, K. Takai, T. Tokuyama, O. Hayaishi: "Enzymatic Modification of Tryptophan Residues by Tryptophan Side Chain Oxidase I and II from Pseudomonas" Journal of Biological Chemistry, vol. 256, No. 15, 1981, pp 7834–7843, XP002110137 American Society of Biological Chemists, Baltimore, MD, US ISSN: 0021–9258.

L.K.H. Vinograd, N.P. Sorokina, K.F. Turchin, R.A. Dibinskii, N.N. Suvorov: "Electrochemical synthesis of .beta.–oxotryptophan" J. Org. Chem. USSR (JOCYA9), vol. 16, No. 12, 1980, pp 2222–2226, XP002110138.

A. Mustafa, W. Asker, O.H. Hishmat, M.I. Ali, A.–K.E. Mansour, N.M. Abed, K.M.A. Kahalil, S.M. Samy: "Synthesis of Substituted Linear Furano '2,3–g!'1!benzopyrones and '3,2–b!Thianaphthenones" Tetrahedron, vol. 21, 1965, pp 849–859, XP002110139 Elsevier Science Publishers, Amersterdam, NL ISSN: 0040–4020.

R.M. Mohareb: "Phenyl Isothiocyanate in Heterocyclic Synthesis: Novel Synthesis of Thiazoles, Thieno '2,3–b!pyridine, Thiophene and Thieno '3,2–c!pyridazine Derivatives" Monatsh>Chem (MOCMB7, 0026–9247), vol. 123, 1992, pp 341–347, XP002110140—Abstract.

* cited by examiner

*Primary Examiner*—Janet Baxter
*Assistant Examiner*—Amanda C. Walke
(74) *Attorney, Agent, or Firm*—Arthur E. Kluegel

(57) ABSTRACT

The specification discloses a photographic element comprising a light-sensitive silver halide emulsion layer having associated therewith a dye-forming coupler having Formula F-1:

F-1 wherein:

(1) $W^1$ is a heteroatom or heterogroup;

(2) X is hydrogen or a coupling-off group other than halogen, and Y and Z are independently selected from hydrogen or a substituent;

(3) $W^4$ and $W^5$ are, independently, either hydrogen or a substituent;

(4) $R^1$ is hydrogen or a substituent group, other than unsubstituted phenyl, and is attached through the oxygen atom to a position meta or para to the carbon link to the heterocycle containing $W^1$; and (5) each $R^2$ is an independently selected substituent, and n is 0 to 4;

provided that any substituents may join to form a ring.

21 Claims, No Drawings

YELLOW COUPLER, PHOTOGRAPHIC ELEMENT, AND PROCESS

FIELD OF THE INVENTION

This invention relates to a photographic element containing a silver halide emulsion layer having associated therewith a dye forming coupler based on an annulated heterocyclic keto-acetamido compound.

BACKGROUND OF THE INVENTION

Conventional color photographic images are formed via a chromogenic development process. After exposure of a color photographic element, the object scene is stored as a composite of red, green, and blue latent silver halide images. During processing, these images are reductively developed in presence of a developer. Oxidized developer produced under these conditions reacts with cyan, magenta or yellow dye-forming deprotonated couplers to give their respective dyes. The composite dye image is then formed by the superpositioning of the cyan, magenta and yellow dye images to afford a reproduction of the original scene.

An important feature of photographic reproductions is their image stability. The stability of a color image is clearly dependent upon the stability of its component dyes. Pictures held in the dark, that is, stored in albums, boxes or slide trays and not exposed to direct light, degrade primarily via hydrolytic thermal mechanisms. Images exposed to light, on the other hand, degrade via both photochemical and such hydrolytic mechanisms. The importance of photochemical fade depends largely on the extent to which the image is exposed to light. It is apparent from these considerations that the photolytic stability of photographic dyes is of prime importance to image stability.

Yellow couplers comprising acylacetamide groups with a heterocycle bonded to the acyl group are shown in U.S. Pat. No. 5,674,667 and in copending application U.S. application Ser. No. 09/069,651 filed Apr. 29, 1998. Although such couplers provide desirable properties, the dyes formed therefrom are more sensitive to photolytic or light degradation than is desired.

It has been found now that certain new 2-alkoxyaryl-substituted heterocyclic-acetanilide yellow couplers can afford yellow azomethine dyes with improved photolytic stabilities, over that provided by previously described heterocyclic-acetanilide couplers

SUMMARY OF THE INVENTION

The invention provides a photographic element comprising a light-sensitive silver halide emulsion layer having associated therewith a dye-forming coupler having Formula F-1:

F-1

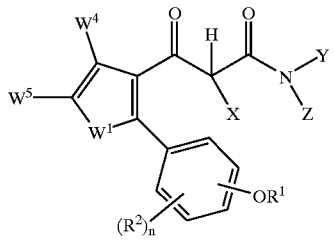

wherein:

(1) $W^1$ is a heteroatom or heterogroup;

(2) X is hydrogen or a coupling-off group other than halogen, and Y and Z are independently selected from hydrogen or a substituent;

(3) $W^4$ and $W^5$ are, independently, either hydrogen or a substituent group;

(4) $R^1$ is hydrogen or a substituent group, other than unsubstituted phenyl, and is attached through the oxygen atom to a position meta or para to the carbon link to the heterocycle containing $W^1$; and (5) each $R^2$ is an independently selected substituent, and n is 0 to 4;

provided that any substituents may join to form a ring.

The invention also provides a coupler compound, a dye compound, and an imaging method using the photographic element.

The element of the invention provides improved dye light fade resistance.

DETAILED DESCRIPTION OF THE INVENTION

The invention is generally described in the Summary of the Invention section. Embodiments of the invention are more fully described as follows.

$W^1$ is a heteroatom or heterogroup. Examples are those where $W^1$ comprises an atom of nitrogen, oxygen, or sulfur. In particular, $W^1$ may be —N($R^3$)—, —O—, —S—, or —$SO_2$— where $R^3$ is an alkyl or aryl group. The nitrogen containing group is suitable. $R^3$ is typically alkyl of 1 to 12 carbon atoms such as methyl, ethyl, propyl, butyl and dodecyl. Also suitable are phenyl groups.

$R^1$ is hydrogen or a substituent group, other than unsubstituted phenyl, and is attached through the oxygen atom to a position meta or para to the carbon link of the aryl ring to the heterocycle containing $W^1$. $R^1$ may represent a group linking two adjacent positions of the aryl ring to which it is attached. Preferred examples of R1 are hydrogen and alkyl groups such as alkyl groups having up to 12 carbon atoms including methyl, ethyl, propyl, butyl, dodecyl, benzyl, and groups forming a ring fused with the adjacent position of the aryl ring. Up to 4 optional groups $R^2$ may also be present and such groups may be combined with $R^1$ or each other to form a fused ring.

$W^4$ and $W^5$ are, independently, either hydrogen or a substituent group. They may together constitute a fused ring. Substituent groups include a fused phenyl ring group with or without substituents such as a carbonamido, cyano, or alkoxy group.

The groups are hydrogen or a substituent. Suitably, Y is hydrogen, and Z is a substituent such as a phenyl group. Desirably, when Z is a phenyl group it bears a halogen or alkoxy group ortho to the amine nitrogen. Typically, the phenyl group Z also bears an electron-withdrawing group such as a sulfone, sulfonamide, or carboxyl group.

X represents hydrogen or a coupling-off group. Typically coupling-off groups are connected to the coupling position by an atom of nitrogen, oxygen or sulfur. Desirable are phenoxy and n-heterocycle compounds as known in the art.

Substituents may join to form a ring.

The process of the invention provides for processing the element with a color developer after imagewise exposure to light.

The imaging process of the invention is any process for forming an image in an element of the invention using a color developer. If desired it may be a reversal element in which the image is first developed with a non-color developer followed by uniform fogging and development with a color developer. The element may also be a color negative provided on transparent film designed for optical printing or one on a transparent or reflective support designed for forming a positive image to be directly or indirectly viewed.

Unless otherwise specifically stated, the term substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfmyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4- equivalent coupler, and the presence of another coupling-off group usually provides a 2-equivalent coupler. Representative classes of such coupling-off groups include, for example, alkoxy, aryloxy, hetero-oxy, sulfonyloxy, acyloxy, acyl, heterocyclyl, sulfonamido, mercaptotetrazole, benzotriazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094;

4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,41 1; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

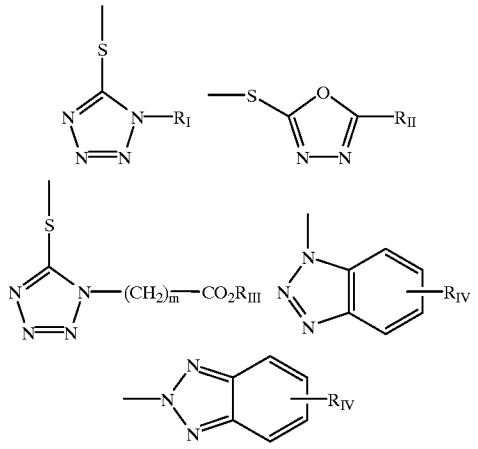

wherein $R_1$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and $-SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $-COOR_V$ and $-NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

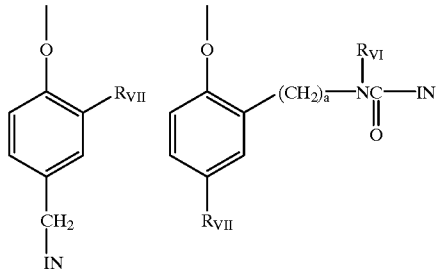

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

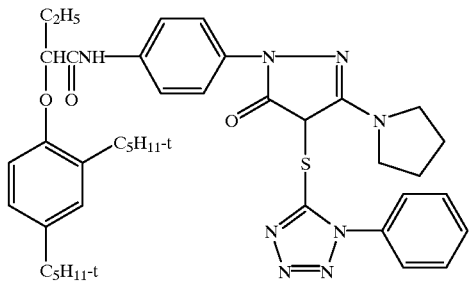

-continued
D2
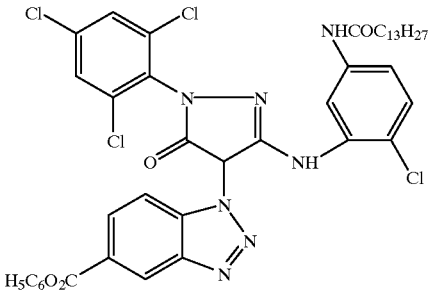
D3
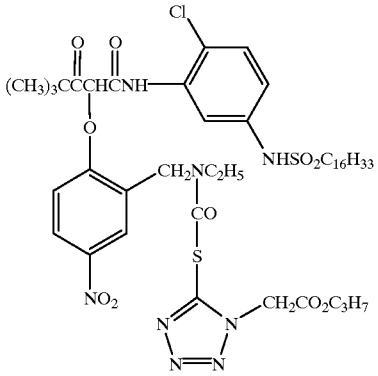
D4
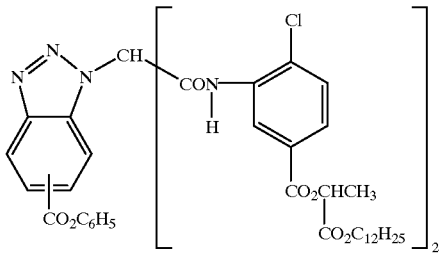
D5
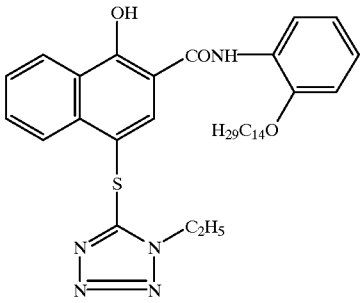
-continued
D6
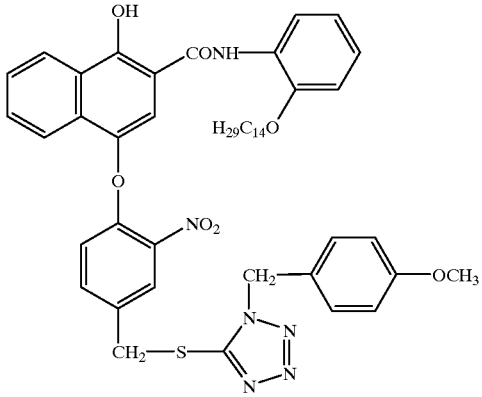
D7
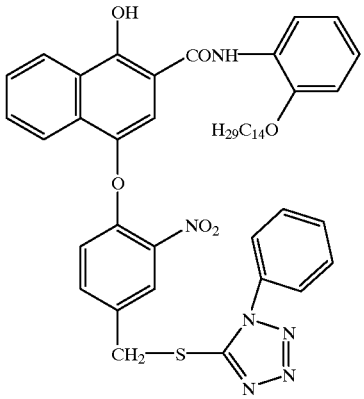
D8
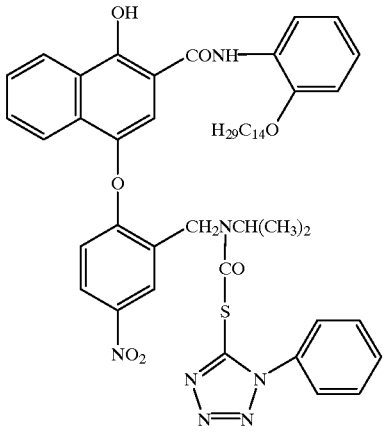

-continued

D9

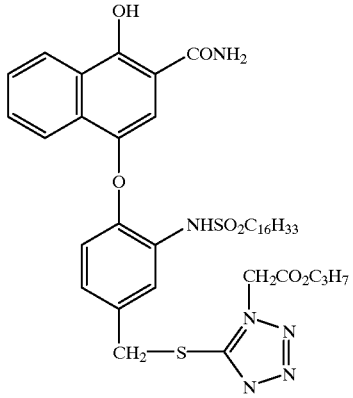

D10

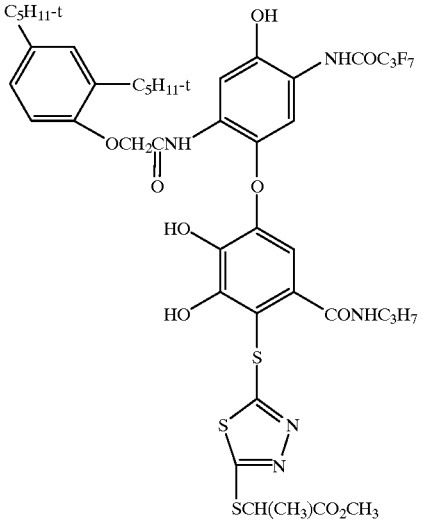

D11

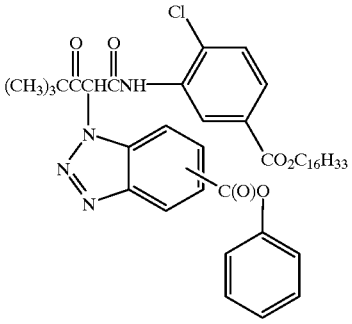

-continued

D12

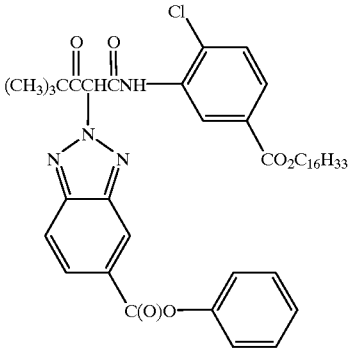

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691;,90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by Research Disclosure , Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501,, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. Nos. 5,470,698, Fenton et al U.S. Pat. No. 5,476,760, Eshelman et al U.S. Pat. Nos. 5,612,,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The yellow coupler of the invention may be employed, for example in elements comprising the following:

In a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coup 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coup 2": Propanoic acid, 2-[[5-[[4-[2-[[[2,4-bis(1,1-dimethylpropyl)phenoxy] acetyl]amino]-5-[(2,2,3,3,4,4,4-heptafluoro-1-oxobutyl)amino]-4-hydroxyphenoxy]-2,3-dihydroxy-6-[(propylamino)carbonyl ]phenyl]thio]-1,3,4-thiadiazol-2-yl]thio]-, methyl ester and "Coup 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coup 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coup 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coup 6": Carbamic acid, (6-(((3-(dodecyloxy)propyl) amino)carbonyl)-5-hydroxy-1-naphthalenyl)-, 2-methylpropyl ester, "Coup 7": Acetic acid, ((2-((3-(((3-(dodecyloxy)propyl)amino) carbonyl)-4-hydroxy-8-(((2-methylpropoxy)carbonyl) amino)-1-naphthalenyl)oxy )ethyl)thio)-, and "Coup 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coup 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coup 10": Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl)amino)phenyl)-, in addition to Coups 3 and 8;

(5) an interlayer;

(6) a triple-coat cyan pack with a fast cyan layer containing Coups 6 and 7; a mid-cyan containing Coup 6 and "Coup 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Coups 2 and 6;

(7) an undercoat layer containing Coup 8; and (8) an antihalation layer.

In a color paper format, the materials of the invention may replace or supplement the materials of an element comprising a support bearing the following layers from top to bottom:

(1) one or more overcoats;

(2) a cyan layer containing "Coup 1": Butanamide, 2-(2,4-bis(1,1-dimethylpropyl)phenoxy)-N-(3,5-dichloro-2-hydroxy-4-methylphenyl)-, "Coup 2": Acetamide, 2-(2,4-bis(1,1-dimethylpropyl)phenoxy)-N-(3,5-dichloro-2-hydroxy-4-methylphenyl)-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coup 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coup 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coup 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coup 1 and "Coup 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coup 2;

(4) an interlayer;

(5) a layer of fine-grained silver;

(6) an interlayer;

(7) a triple-coated magenta pack with a fast and mid magenta layer containing "Coup 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coup 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coup 5": Benzamide, 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Coups 4 and 5 with the same stabilizer;

(8) one or more interlayers possibly including fine-grained nonsensitized silver halide;

(9) a triple-coated cyan pack with a fast cyan layer containing "Coup 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coup 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coup 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-; and a slow cyan layer containing Coups 6, 7, and 8;

(10) one or more interlayers possibly including fine-grained nonsensitized silver halide; and

(11) an antihalation layer.

Specific examples of coupler useful in the invention are as follows (Ph=phenyl):

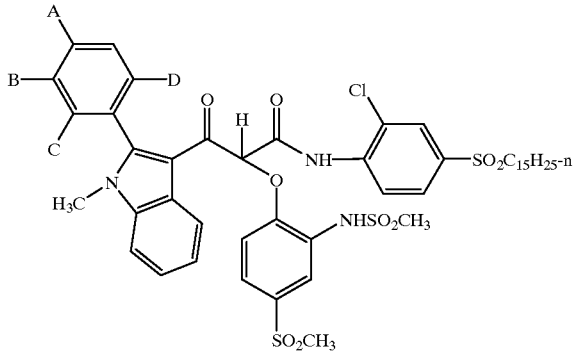

| Coupler | Type | A | B | C | D |
|---|---|---|---|---|---|
| Ex-1 | Inv | —$OCH_3$ | H | H | H |
| Ex-2 | Inv | —$OCH(CH_3)_2$ | H | H | H |
| Ex-3 | Inv | —$OCH_3$ | H | —$OCH_3$ | H |
| Ex-4 | Inv | H | —$OCH_3$ | H | —$OCH_3$ |
| Ex-5 | Inv | —$OCH_2O$— | | H | H |
| Ex-6 | Inv | —$OCH_2C_6H_5$ | —$OCH_3$ | H | H |
| Ex-7 | Inv | —OH | —$OCH_3$ | H | H |
| Ex-8 | Inv | —$OCH_3$ | —CH=CH—CH=CH— | | H |

Ex-9

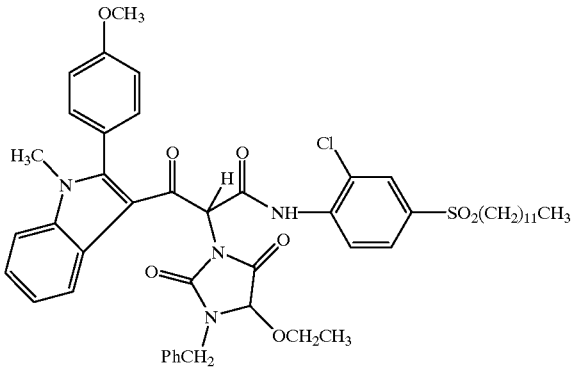

Ex-10

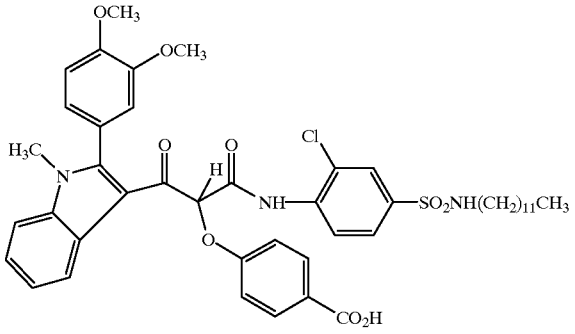

Ex-11

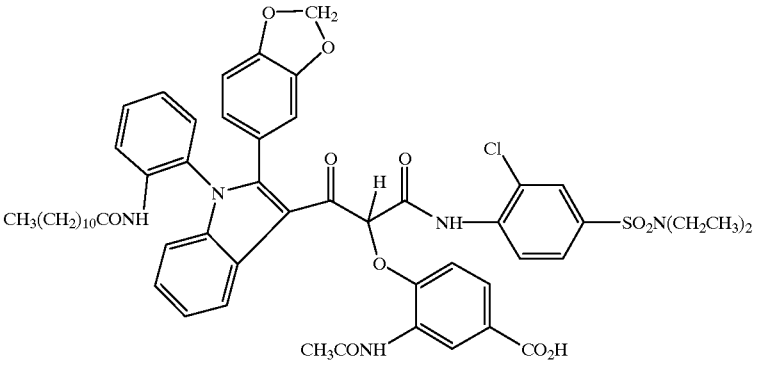

-continued
Ex-12
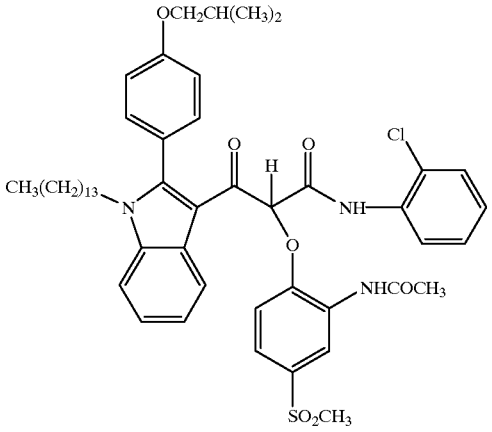
Ex-13
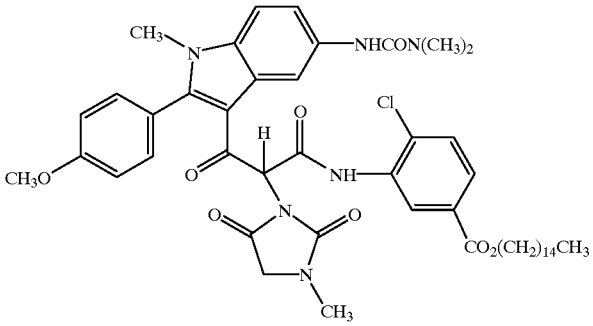
Ex-14
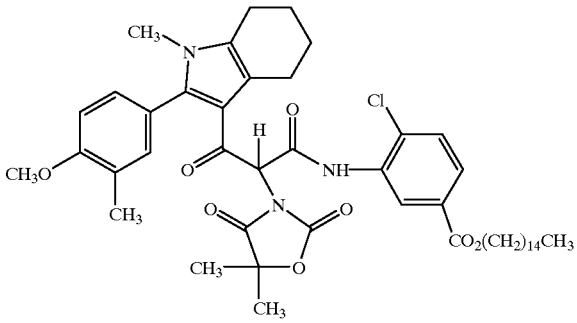
Ex-15
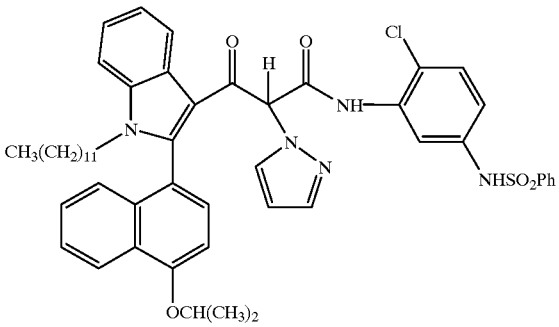
Ex-16
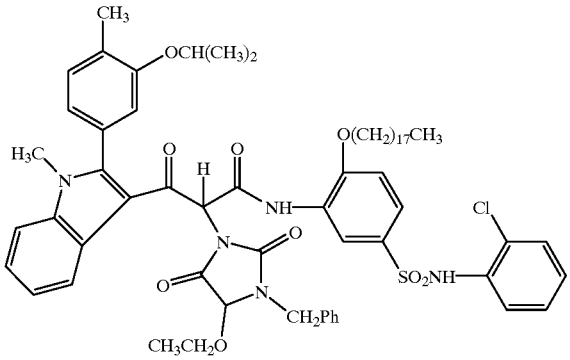
Ex-17
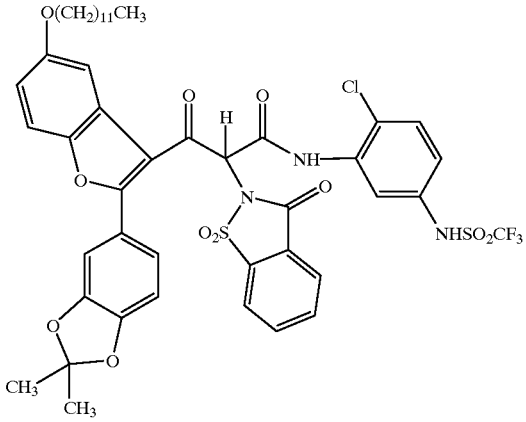
Ex-18
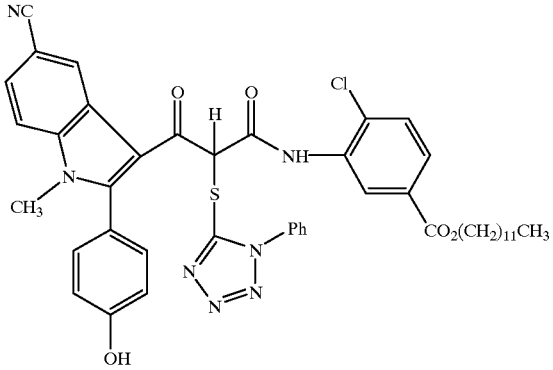
Ex-19
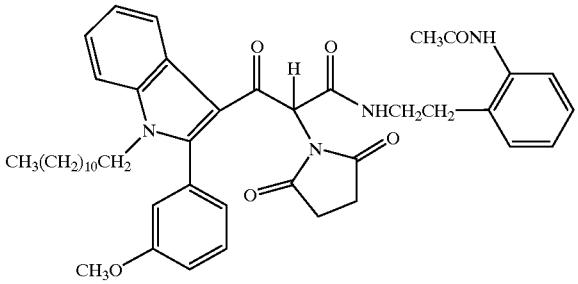

-continued
Ex-20
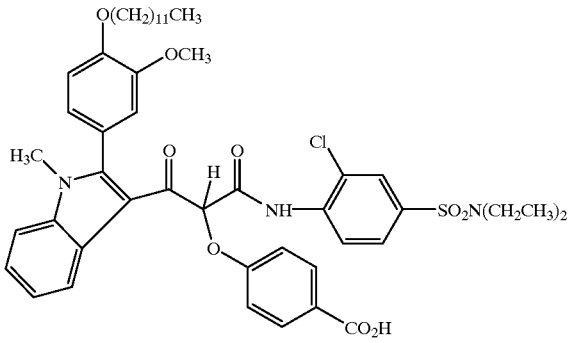
Ex-21
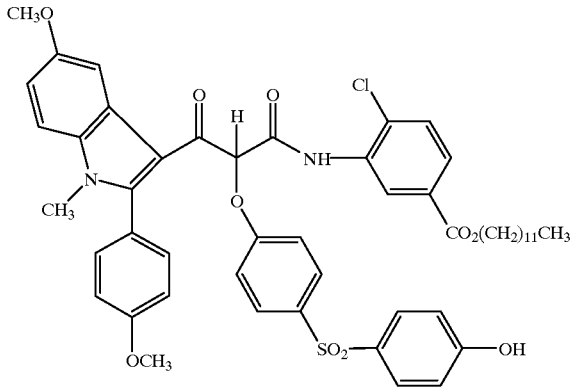
Ex-22
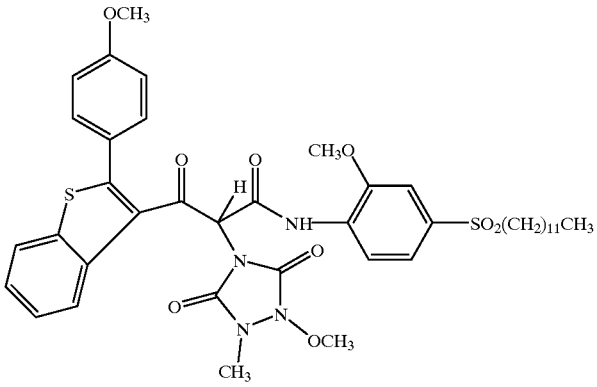
Synthetic Scheme: The following demonstrates a method of preparing couplers useful in the invention.
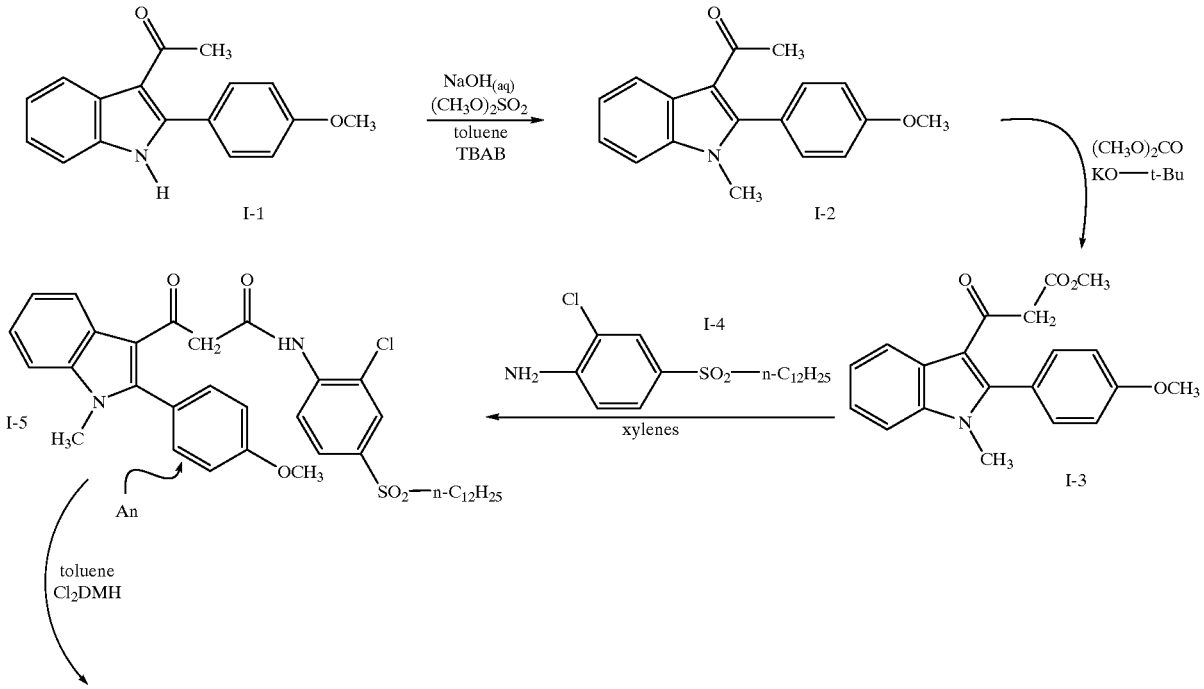

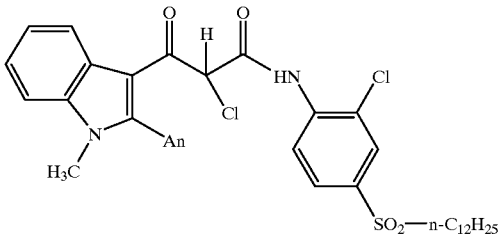

I-6

-continued

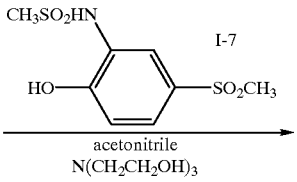

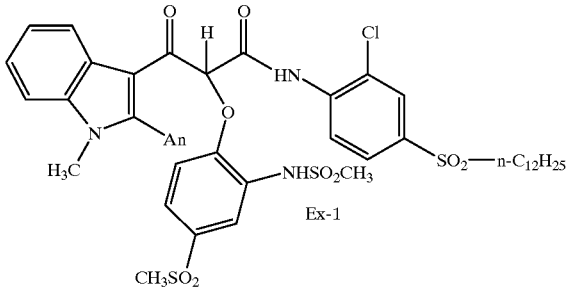

Ex-1

Synthetic Examples: Couplers were prepared as follows.

Preparation of 1-Methyl-2-(4'-methoxyphenyl)-3-acetylindole I-2, a prototypical methylation reaction): A mixture of potassium hydroxide (62.11 g, 1.11 mol), dimethyl sulfoxide (75 mL) and dimethyl sulfate (24 ml) was charged to a round bottom flask fixed with a thermometer. 2-(4'-methoxyphenyl)-3-acetylindole (CAS No.133437-40-8: 65.38 g, 0.25 mol) was dissolved in dimethyl sulfoxide and charged to an addition funnel. The indole solution was added dropwise to the round bottom flask while keeping the temperature of the reaction below 25° C. After complete addition the reaction was stirred an additional hour at room temperature and poured into 3 L of water. The yellow solids were collected and washed with water to give 55.1 g of I-2 (80%). This material was chromatographically homogenous and displayed an NMR spectrum consistent with its structure.

Preparation of Methyl 2-(4'-methoxyphenyl)-1-methylindol-3-oyl-acetoacetate (I-3): A mixture of I-2 (39.82 g, 0.14 mol), dimethyl carbonate (150 ml, 1.78 mol) and potassium tert-butoxide (40 g, 0.36 mol) was heated at reflux for 16 hours under a nitrogen atmosphere. After cooling to room temperature the resulting mixture was poured into water (2 L) and extracted with ethyl acetate (2×500 ml). The organic extracts were combined and washed with 500 ml of water, dried over $MgSO_4$, filtered and concentrated in vacuo. This dark oil was loaded with toluene onto a silica-gel/heptane column and eluted with 20% ethyl acetate/heptane to remove unreacted starting material. Elution with 50% ethyl acetate/heptane gave 2 (33.1 g, 69% yield). Recrystallization from dichloromethane/isopropyl ether gave a crystalline solid. This product was chromatographically homogenous and displayed an NMR spectrum consistent with its structure.

Preparation of I-5 (a prototypical anilide forming reaction): A solution of I-3 (33.8 g, 0.10 mol), I-4 (CAS No. 164650-26-4; 39.6 g, 0.11 mol) and 350 ml of xylenes was heated at reflux for 21 hours under a nitrogen atmosphere. Two hundred milliliters of xylenes was removed by distillation and the remaining solution concentrated in vacuo. Recrystallization of this solid from methanol gave pure I-5 (51.4 g, 77% yield) as a light brown solid. This material was chromatographically homogenous and displayed an NMR spectrum consistent with its structure.

Preparation of I-6 (a prototypical chlorination reaction): A solution of I-5 (20 g, 0.030 mol), 1,3-dichloro-5,5-dimethylhydantoin (2.98 g, 0.015 mol) and 100 ml of toluene was heated at reflux for two hours. The reaction was cooled to room temperature and the hydantoin precipitate removed by filtration. The filtrate was concentrated in vacuo and used in subsequent steps without further purification.

Preparation of Ex-I (a prototypical preparation of a coupler with a phenolic coupling-off-group): A solution of 1-5 (as prepared above), triethanolamine (6.8 g, 0.045 mol), I-7 (9.2 g, 0.035 mol) and 100 ml of acetonitrile was heated at reflux for 2 hours. The mixture was cooled to room temperature and the solid byproduct was filtered off and discarded; the solvent was removed from the filtrate in vacuo and the residue triturated first with 250 mL methanol, then with 350 mL diisopropyl ether. Recrystallization of the derived solid from 500 mL methanol gave analytically pure Ex-1 (18.0 g, 64%). This material was chromatographically homogenous and displayed an NMR spectrum consistent with its structure.

Photographic Examples

Coating Preparation: Monochrome photographic coatings of the couplers were prepared on a gel-subbed, acetate support using the following format:

First Layer: a photosensitive layer containing (per square meter) 3.23 g gelatin, 0.86 g blue-sensitized silver bromo-iodide emulsion, a coupler dispersion containing $2.69\times10^{-3}$ mole of coupler, 0.027 g surfactant Olin 10 G, 0.055 g surfactant Triton X-200®. The coupler dispersion contained the coupler, coupler solvent (coupler: solvent 1:0.33 di-n-butyl sebacate), 6% gelatin, and Alkanol XC at a level equal to 10% of the weight of the gelatin in the dispersion.

Second Layer: A protective layer containing (per square meter) 0.97 g gelatin and 0.086 g bis-(vinylsulfonyl) methane.

Exposure and Processing: The samples were subjected to stepwise light exposure using the following exposure conditions: 1B sensitometer, 0.01 sec using HA-50, DLVa and 0.6 inconel filters, and 0–3 step tablet. Samples were then processed using process E-6 solutions and conditions as follows:

| Process Step | Time (min.) | Temp (C.) | Agitation |
|---|---|---|---|
| 1st developer | 3.0 | 36.9 | $N_2$ burst (2" on, 8" off) |
| 1st wash | 2.0 | 36.9 | No Agitation |
| Reversal Bath | 2.0 | 36.9 | No Agitation |
| Color Developer | 6.0 | 36.9 | $N_2$ burst |
| Prebleach | 2.0 | 36.9 | No Agitation |
| Bleach | 6.0 | 36.9 | Continuous air |
| Fixer | 4.0 | 36.9 | $N_2$ burst |
| Final Wash | 4.0 | 36.9 | No Agitation |

Light Stability: The density of a test strip step as close to D=1.0 as possible is measured; this density is then compared to the dye density remaining at that step after exposure to irradiation by a xenon lamp at an intensity of 5.4 KLux for 3 weeks. Light stability is represented as the percentage of density lost from the D=1.0 step after exposure to the fade conditions.

Couplers were prepared and evaluated during this experiment using the standard test format described earlier. These compounds included eight lo compounds useful in the invention, as described earlier, as well as a comparison with no 2-aryl substituents (Cp-1) and two comparisons with oxygen substituents outside the scope of the invention. (Cp-2 is a positional isomer not within the invention while Cp-3 bears a phenoxy substituent that is not within the invention).

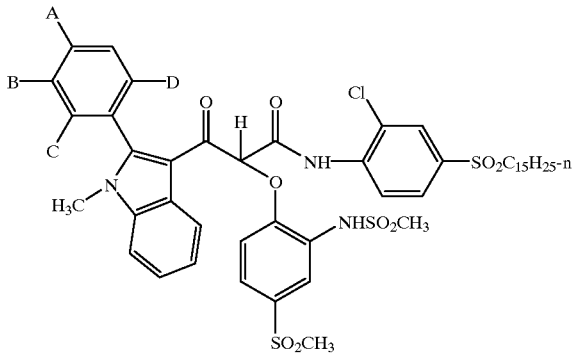

Comparative Couplers

| | A | B | C | D |
|---|---|---|---|---|
| Cp-1 | H | H | H | H |
| Cp-2 | H | H | —$OCH_3$ | H |
| Cp-3 | —$OC_6H_5$ | H | H | H |

The results of testing were as follows:

Light Stability Results

| Compound | Type | % Dye Fade |
|---|---|---|
| Cp-1 | Comp | −55 |
| Cp-2 | Comp | −57 |
| Cp-3 | Comp | −58 |
| Avg | | −57 |
| Ex-1 | Inv | −36 |
| Ex-2 | Inv | −31 |

-continued

Light Stability Results

| Compound | Type | % Dye Fade |
|---|---|---|
| Ex-3 | Inv | −55 |
| Ex-4 | Inv | −38 |
| Ex-5 | Inv | −33 |
| Ex-6 | Inv | −36 |
| Ex-7 | Inv | −47 |
| Ex-8 | Inv | −59 |
| Avg | | −42 |

As may be observed, the compounds of the invention provided an average improvement in dye fade of from 57 to 42%, a relative improvement of over 25%. Some of the better performing couplers exhibited a relative improvement on the order of 45%.

What is claimed is:

1. A photographic element comprising a silver halide emulsion layer having associated therewith a dye-forming coupler having Formula F-1: wherein:

F-1

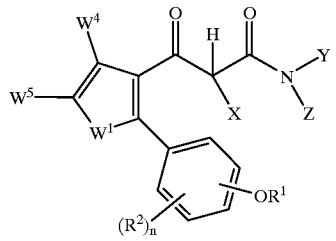

wherein:

(1) $W^1$ is a heteroatom or heterogroup;

(2) X is hydrogen or a coupling-off group other than halogen, and Y and Z are independently selected from hydrogen or a substituent;

(3) $W^4$ and $W^5$ are, independently, a substituent wherein $W^4$ and $W^5$ join to form a fused aromatic ring;

(4) $R^1$ is hydrogen or a substituent group, other than unsubstituted phenyl, and is attached through the oxygen atom to a position meta or para to the carbon link to the heterocycle containing $W^1$; and (5) each $R^2$ is an independently selected substituent, and n is 0 to 4;

provided that any substituents may join to form a ring.

2. The element of claim 1 wherein $W^1$ comprises an atom of nitrogen, oxygen, or sulfur.

3. The element of claim 2 wherein $W^1$ is selected from the group consisting of —$N(R^3)$—, —O—, —S—, and —$SO_2$—, where $R^3$ is an alkyl or aryl group.

4. The element of claim 3 wherein $W^1$ is —$N(R^3)$—.

5. The element of claim 1 wherein $R^1$ is hydrogen.

6. The element of claim 1 wherein $R^1$ is an alkyl group.

7. The element of claim 6 wherein $R^1$ is an alkyl group of 1 to 12 carbon atoms.

8. The element of claim 7 wherein $R^1$ is a methyl, ethyl, propyl, butyl, dodecyl, or benzyl group.

9. The element of claim 8 wherein $R^1$ is a methyl group.

10. The element of claim 8 wherein $R^1$ is a benzyl group.

11. The element of claim 6 wherein $R^1$ represents a group linking two adjacent positions of the aryl ring.

12. The element of claim 1 wherein Y is hydrogen and Z is a phenyl group.

13. The element of claim 12 wherein the phenyl group contains a halogen or alkoxy substituent ortho to the nitrogen atom linking to the balance of the coupler.

14. The element of claim 13 wherein the phenyl group bears an additional substituent group containing an —$SO_2$— group.

15. The element of claim 1 wherein X is linked to the rest of the coupler by an atom of nitrogen, oxygen or sulfur.

16. The element of claim 15 wherein X is a phenoxy group.

17. The element of claim 15 wherein X is an N-heterocycle.

18. The element of claim 1 wherein $W^1$ is —$N(R^3)$— where $R^3$ is an alkyl or aryl group, $R^1$ is an alkyl group, Y is hydrogen, Z is an ortho-substituted phenyl group, and X is a phenoxy group.

19. A process for forming an image in a photographic element as described in claim 1 after image-wise exposure to light, comprising contacting the element with a color developer.

20. A photographic element comprising a silver halide emulsion layer having associated therewith a dye-forming coupler having Formula F-1:

F-1

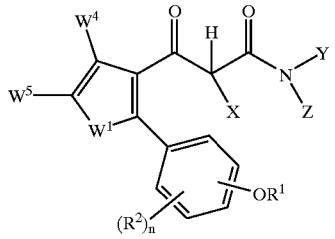

wherein:

(1) $W^1$ is a heteroatom or heterogroup;

(2) X is hydrogen or a coupling-off group other than halogen, and Y and Z are independently selected from hydrogen or a substituent;

(3) $W^4$ and $W^5$ are, independently, either hydrogen or a substituent;

(4) $R^1$ is hydrogen and is attached through the oxygen atom to a position meta or para to the carbon link to the heterocycle containing $W^1$; and (5) each $R^2$ is an independently selected substituent, and n is 0 to 4;

provided that any substituents may join to form a ring.

21. A photographic element comprising a silver halide emulsion layer having associated therewith a dye-forming coupler having Formula F-1:

F-1

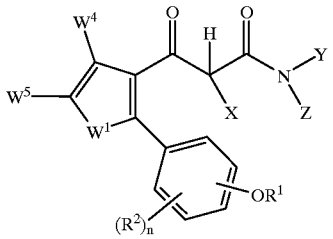

wherein:

(1) $W^1$ is a heteroatom or heterogroup; (2) X is hydrogen or a coupling-off group other than halogen, and Y and Z are independently selected from hydrogen or a substituent;

(3) $W^4$ and $W^5$ are, independently, either hydrogen or a substituent;

(4) $R^1$ is a benzyl group and is attached through the oxygen atom to a position meta or para to the carbon link to the heterocycle containing $W^1$; and (5) each $R^2$ is an independently selected substituent, and n is 0 to 4;

provided that any substituents may join to form a ring.

* * * * *